US007053885B2

(12) United States Patent
Seya

(10) Patent No.: US 7,053,885 B2
(45) Date of Patent: May 30, 2006

(54) MULTI-DIRECTIONAL INPUT KEY AND KEY INPUT DEVICE

(75) Inventor: Yasuhiro Seya, Tamakawa-mura (JP)

(73) Assignee: Polymatech Co., Ltd., Tokyo (JP)

( * ) Notice: Subject to any disclaimer, the term of this patent is extended or adjusted under 35 U.S.C. 154(b) by 450 days.

(21) Appl. No.: 10/435,479

(22) Filed: May 12, 2003

(65) Prior Publication Data

US 2003/0210234 A1 Nov. 13, 2003

(30) Foreign Application Priority Data

May 13, 2002 (JP) ..... 2002-137625
Jan. 23, 2003 (JP) ..... 2003-015453

(51) Int. Cl.
*G09G 5/00* (2006.01)

(52) U.S. Cl. ..... 345/172; 345/168

(58) Field of Classification Search ..... 345/156, 345/161, 164, 167, 168, 169, 160, 172; 200/6, 200/5, 415, 329, 330, 341, 517, 310–314, 200/512–520; 361/13, 22; 341/22
See application file for complete search history.

(56) References Cited

U.S. PATENT DOCUMENTS 5,340,953 A 8/1994 Krebs et al.
6,586,689 B1 * 7/2003 Kuriyama ..... 200/6 A
6,653,579 B1 * 11/2003 Inoue et al. ..... 200/6 A
2001/0023816 A1 9/2001 Furiyama
2003/0160761 A1 * 8/2003 Wu ..... 345/161

FOREIGN PATENT DOCUMENTS

EP 0 905 599 A2 3/1999
EP 1 168 393 A2 1/2002
EP 1 168 393 A2 1/2002
JP 0 905 599 A2 3/1999

OTHER PUBLICATIONS

European Search Report dated Aug. 11, 2003.
Chinese Office Action completed on Dec. 7, 2004.

* cited by examiner

*Primary Examiner*—Vijay Shankar
*Assistant Examiner*—Nitin Patel
(74) *Attorney, Agent, or Firm*—Rader, Fishman & Grauer

(57) ABSTRACT

Disclosed are a multi-directional input key and a key input device helping to suppress erroneous input through the input key and providing a satisfactory operability. The multi-directional input key has an operation portion, on which are formed rectifying protrusions adapted to come into contact with the circuit board before the board contacts are brought into conduction upon tilting the operation portion to thereby rectify the tilting attitude of the operation portion toward the normal tilting direction. Even when the key top is tilted in an oblique direction deviated from the normal tilting direction, the rectifying protrusions come into contact with the upper surface of the printed circuit board before the board contacts are brought into conduction to thereby rectify the tilting direction of the key top to the normal tilting direction.

12 Claims, 14 Drawing Sheets

MULTI-DIRECTIONAL INPUT KEY AND KEY INPUT DEVICE

BACKGROUND OF THE INVENTION

1. Field of the Invention

This invention relates to a multi-directional input key and a key input device for a pushbutton switch for performing an input operation on an electronic apparatus, such as a portable information terminal apparatus like a mobile telephone or PDA, an AV apparatus, a car navigation system, or a remote controller for various apparatuses.

2. Description of the Related Art

An electronic apparatus is equipped with a number of input keys for executing the functions thereof. With the recent increase in the number of functions of electronic apparatuses, there has been developed a system in which a single input key is used for different input purposes.

As an example of such a system, FIG. 16 shows a mobile telephone 1, which is equipped with an input key group 2 consisting of various keys with figures, symbols, patterns, etc. As shown in FIG. 17, there is provided above the input key group 2 an input key 3 protruding through a mounting hole 1*b* of a casing 1*a*. This input key 3 is generally called a multi-directional input key and constructed as follows. A stick-like key top 5 formed of hard resin is joined with adhesive (not shown) to a key sheet 4 formed of a rubber-like resilient member such as silicone rubber or thermoplastic elastomer. Thus, through resilient deformation of the key sheet 4, the key top 5 is capable of being tilted in all directions of 360 degrees. Normally, the key top 5 is tilted upwards, downwards, to the right, and to the left, whereby one of a plurality of selection items displayed on a display screen 6 can be selected, and a cursor displayed on the display screen 6 can be moved upwards, downwards, to the right, and to the left. And, to make it possible to perform such operations, the input key 3 is equipped with contact input portions 7 formed on the key sheet 4 and consisting of conductive ink or the like, and board contacts 8 formed on a circuit board 8. As shown in FIG. 17, as the key top 5 is tilted in the different directions, these contact portions and board contacts come into contact with each other to be thereby brought into conduction.

In this way, the input key 3, which allows multi-directional input, advantageously meets the mutually contradictory requirements in an electronic apparatus: an increase in the number of functions and space saving. Thus, it is used in various electronic apparatuses inclusive of the mobile telephone 1. However, from the viewpoint of operability, the results obtained therefrom up to now are not always satisfactory.

That is, as long as the input key 3 is tilted in the normal tilting directions through depression, the board contacts 9 of the circuit board 8 can be brought into conduction. However, the very fact that it is capable of being tilted in all directions of 360 degrees allows the input key to be easily tilted obliquely in the wrong directions. In such cases, not only the board contact 9 of the circuit board 8 to be brought into conduction for input operation, but also another board contact 9 adjacent thereto is likely to be brought into conduction, with the result that input operation has to be conducted again. Moreover, there is a danger of the mobile telephone 1 might be erroneously operated.

This problem of erroneous input also occurs in a case in which the input key 3 allows oblique input through simultaneous conduction of adjacent board contacts 9 as in the case of the upper and right contacts, the upper and left contacts, the lower and right contacts, and the lower and left contacts. Further, this applies not only to the input key 3, called a multi-directional key, but also to an input key in which operating points are indicated by triangular symbols or the like at upper, lower, right, and left positions on a flat depressing operation surface, an input key called a seesaw key having a depressing operation surface of, for example, a rectangular or elliptical configuration, and an input key called a mono-directional key having only one operating point on a rectangular or elliptical operation surface. Thus, there may be cases in which input is not correctly effected on the right board contact 9 even when the operator believes he has tilted the input key in a normal tilting direction.

SUMMARY OF THE INVENTION

The present invention has been made in view of the above problem in the prior art. It is accordingly an object of the present invention to provide a multi-directional input key and a key input device of a satisfactory operability which makes it possible to reduce the possibility of erroneous input through the input key.

To achieve the above object, according to an aspect of the present invention, there is provided a multi-directional input key comprising an operation portion floatingly supported with respect to a circuit board, and contact input portions which are provided to the operation portion and opposed to a plurality of board contacts annularly arranged on the circuit board, in which tilting of the operation portion brings a board contact opposed to the corresponding contact input portion into conduction to effect a predetermined input operation, wherein the operation portion is equipped with a rectifying protrusion adapted to come into contact with the circuit board before the board contact has been brought into conduction by tilting the operation portion to thereby rectify the tilting attitude of the operation portion so that it may be tilted in a normal tilting direction.

According to another aspect of the present invention, there is provided a key input device comprising an input key for performing an input operation, and a circuit board having a plurality of board contacts annularly arranged and opposed to a bottom portion of the input key, in which tilting of the input key brings a board contact into conduction for a predetermined input operation, wherein one of the bottom portion of the input key and the circuit board is equipped with a rectifying protrusion adapted to come into contact with the other one of the bottom portion of the input key and the circuit board before a board contact has been brought into conduction by tilting the input key to thereby rectify the tilting attitude of the input key so that it may be tilted in a normal tilting direction.

In the multi-directional input key and the key input device of the present invention, due to the provision of the rectifying protrusion, even if the input key is not tilted in a normal tilting direction, the tilting attitude is rectified by the rectifying protrusion, which comes into contact with the circuit board or the bottom portion of the input key before the board contact is brought into conduction, making it possible to reliably bring the target board contact into conduction to thereby restrain erroneous input.

In the multi-directional input key, the rectifying protrusion, which provides the above-mentioned effect, can be provided at an outer position with respect to a contact input portion. Further, in the key input device, it can be provided at an outer position with respect to a board contact of the circuit board or at an opposing position at the bottom of the input key opposed to the outer position. By thus providing the rectifying protrusion at an outer position with respect to the contact input portion, etc., it is possible to reliably rectify the tilting attitude at a position near the contact input portion.

When the board contacts are arranged annularly, input is possible for each board contact. However, there are cases in which, in order to make it possible to perform more input operations with a single key, simultaneous conduction of adjacent board contacts is regarded as one input operation. In view of this, in the present invention, a predetermined input operation is effected by simultaneously causing adjacent contact input portions to bring the opposed board contacts into conduction by tilting the operation portion of the multi-directional input key, and a rectifying protrusion is provided at an outer position with respect to an interval portion by which adjacent contact input portions are spaced apart from each other. Further, in the present invention, a predetermined input operation is effected by simultaneously bringing adjacent board contacts into conduction by tilting the input key, and the rectifying protrusion is provided at either an outer position with respect to an interval portion by which adjacent board contacts of the circuit board are spaced apart from each other or an opposing position at the bottom of the input key opposed to the outer position. According to these aspects of the present invention, the input operation to be effected through simultaneous conduction of adjacent board contacts can be reliably effected through rectification of the tilting attitude by the rectifying protrusion.

The above-described multi-directional input key may further comprise a support protrusion for floatingly supporting the rectifying protrusion with respect to the circuit board. Further, the key input device may have on either the input key or the circuit board a support protrusion for supporting the rectifying protrusion floatingly with respect to the circuit board.

And, the multi-directional input key equipped with the support protrusion may be floatingly supported with respect to the circuit board and formed such that it is brought into contact with the circuit board earlier than the rectifying protrusion by tilting the operation portion. Further, the key input device equipped with the support protrusion may be constructed such that the support protrusion is floatingly supported with respect to one of the input key and the circuit board, and that it is brought into contact with the other one of the input key and the circuit board earlier than the rectifying protrusion by tilting the input key. This support protrusion can not only support the rectifying protrusion in a stable manner, but also function so as to rectify the tilting attitude like the rectifying protrusion. Thus, it is possible to rectify the tilting attitude in the two stages of support protrusion and rectifying protrusion, making it possible to effect input through the target board contact more reliably.

And, in the present invention, the multi-directional input key has a contact input portion formed as a downwardly protruding push member portion having a curved rectangular configuration extending along the annular arrangement direction and having a forward end surface parallel to the circuit board.

In this invention, in which the contact input portion is formed as a downwardly protruding push member portion having a curved rectangular configuration extending along the annular arrangement direction and having a forward end surface parallel to the circuit board, the pressurization area for conduction of the board contact is large. In particular, it is possible to achieve an improvement in operability of a multi-directional input key capable of being tilted in all directions of 360 degrees. Further, in this case, when the forward end surface is made longer than the board contact extending along the planar direction of the board circuit, it is possible, in particular, to effect simultaneous conduction of adjacent board contacts, whereby it is possible to achieve an improvement in the input reliability of the multi-directional input key through which a predetermined input is effected.

In the multi-directional input key and the key input device of the present invention described above, any type of circuit board will do as long as it is opposed to the bottom portion of the multi-directional key or the bottom portion of the input key. More specifically, it is possible to adopt a printed circuit board having metal circuit wiring thereon and formed of a flexible resin film or an insulating hard resin. Further, it is also possible to use as the circuit board a membrane switch formed by stacking together a base board of resin film with a board circuit formed thereon by conductive ink or the like, an operation side board of flexible resin film with conductive contacts corresponding to the contact portions of the base board formed thereon by conductive ink or the like, and a spacer layer having a through-hole enabling any depressed conductive contact of the operation side board to come into contact with a contact portion of the base board. The board contacts of this membrane switch consist of the contact portions of the base board and the conductive contacts of the operation side board. And, the rectifying protrusion and the support protrusion in the key input device of the present invention may be provided on these circuit boards.

Further, the multi-directional input key and the input key of the present invention are also applicable to various constructions. Examples of the constructions include a key pad whose depressing operation surface is formed of a rubber-like resilient member of a silicone rubber, thermoplastic elastomer or the like, a key pad with a key top in which a key top of hard resin is joined to a key sheet formed of the rubber-like resilient member, and a resin-film-integrated type input key in which a key top of hard resin is joined to a resin film. In particular, it is necessary for the multi-directional input key of the present invention to be an input key in which input is effected on a board contact through tilting in a predetermined direction. Such an input key may be either of the type in which oscillation is effected in one direction corresponding to one board contact or of the type in which oscillation is effected in a plurality of directions corresponding to a plurality of board contacts.

The above description of this invention should not be construed restrictively. The objects, advantages, features, and uses of this invention will become more apparent from the following description with reference to the accompanying drawings. Further, it is to be understood that this invention allows appropriate modifications without departing from the scope of the gist of the invention.

BRIEF DESCRIPTION OF THE DRAWINGS

In the accompanying drawings:

FIGS. 6A through 6C are partial sectional views of the multi-directional input key of FIG. 1 taken along the line SB—SB, illustrating the operation of the same, of which FIG. 6A is an explanatory view showing the state in which no operation is being performed, FIG. 6B is an explanatory view showing a state in which the multi-directional input key is tilted to bring the rectifying protrusion into contact with the board, and FIG. 6C is an explanatory view showing a state in which a board contact of the printed circuit board is brought into conduction;

FIGS. 7A through 7D are explanatory views of portion SC of FIG. 6A, as seen outwardly from the operation portion, illustrating the operation of the rectifying protrusion, of which FIG. 7A is an explanatory view showing the state in which no operation is being conducted, FIG. 7B is an explanatory view illustrating a state in which the rectifying protrusion is tilted to be brought into contact with the printed circuit board, FIG. 7C is an explanatory view showing a state in which the rectifying protrusion has been brought into full contact, and FIG. 7D is an explanatory view showing a state in which a board contact of the printed circuit board is brought into conduction;

FIGS. 13A through 13C are explanatory views illustrating the operation of the rectifying protrusion, of which FIG. 13A is an explanatory view showing a state in which the rectifying protrusion is tilted to be brought into contact with the printed circuit board, FIG. 13B is an explanatory view showing a state in which the rectifying protrusion is brought into full contact, and FIG. 13C is an explanatory view showing a state in which a board contact of the printed circuit board is brought into conduction;

FIGS. 17A and 17B are partial sectional views taken along the line SA—SA of FIG. 16, of which FIG. 17A is a partial sectional view of the same, and FIG. 17B is an explanatory view illustrating the operation of the input key of FIG. 17A.

DESCRIPTION OF THE PREFERRED EMBODIMENTS

Figure 1:
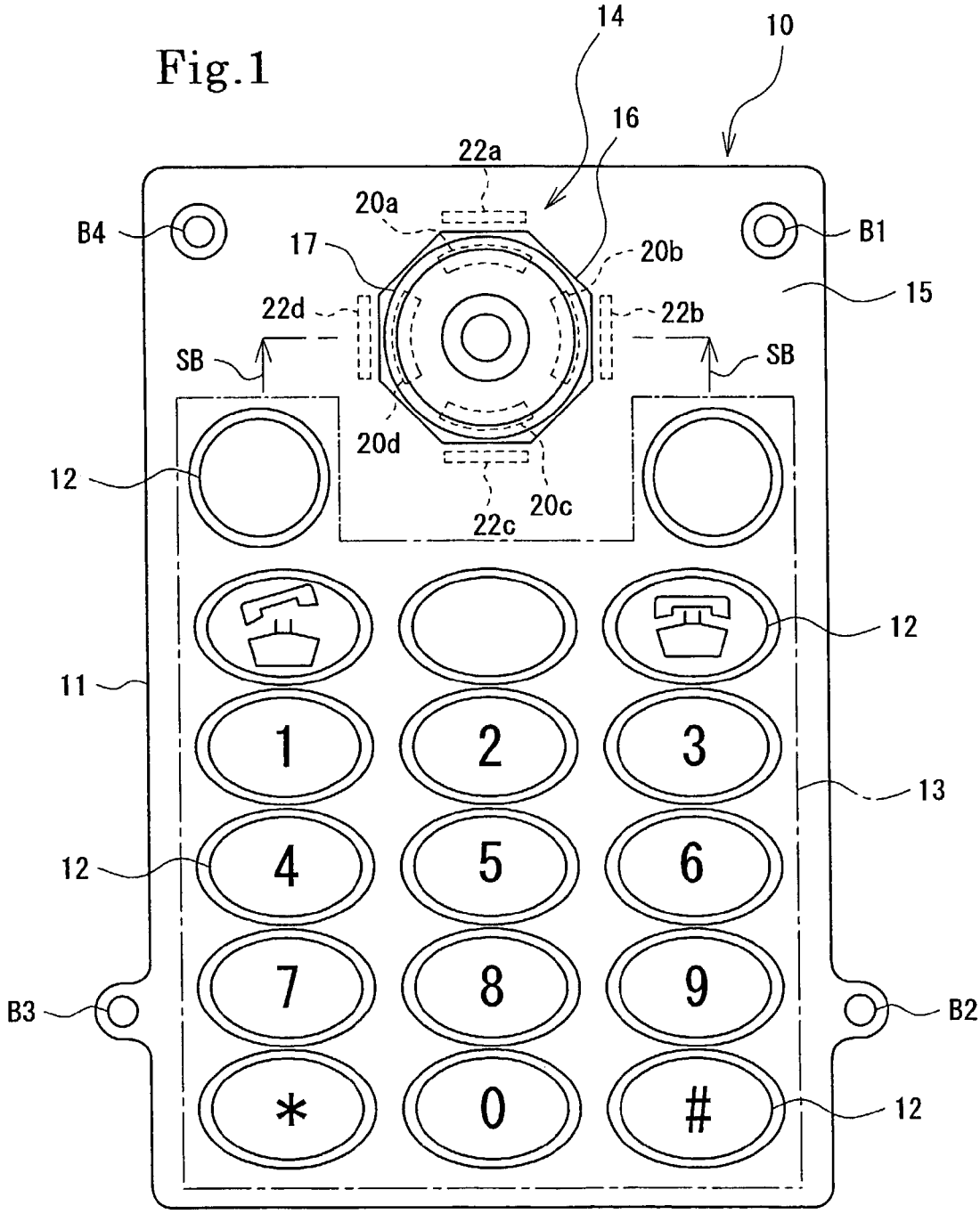
FIG. 1 is a plan view of a key pad equipped with a multi-directional input key according to a first embodiment of the present invention.

Embodiments of the multi-directional input key and the key input device of the present invention will now be described with reference to the drawings. While the embodiments described below are applied to a mobile telephone, they are also applicable to a multi-directional input key or a key input device for a pushbutton switch to be used for input operation of electronic apparatuses, such as a portable information terminal apparatus like PDA, an AV apparatus, a car navigation system, and a remote controller for various apparatuses. Further, the components which are common to the embodiments are indicated by the same reference numerals, and a redundant description of such components will be omitted.

First Embodiment (FIGS. 1 through 7)

Figure 16:
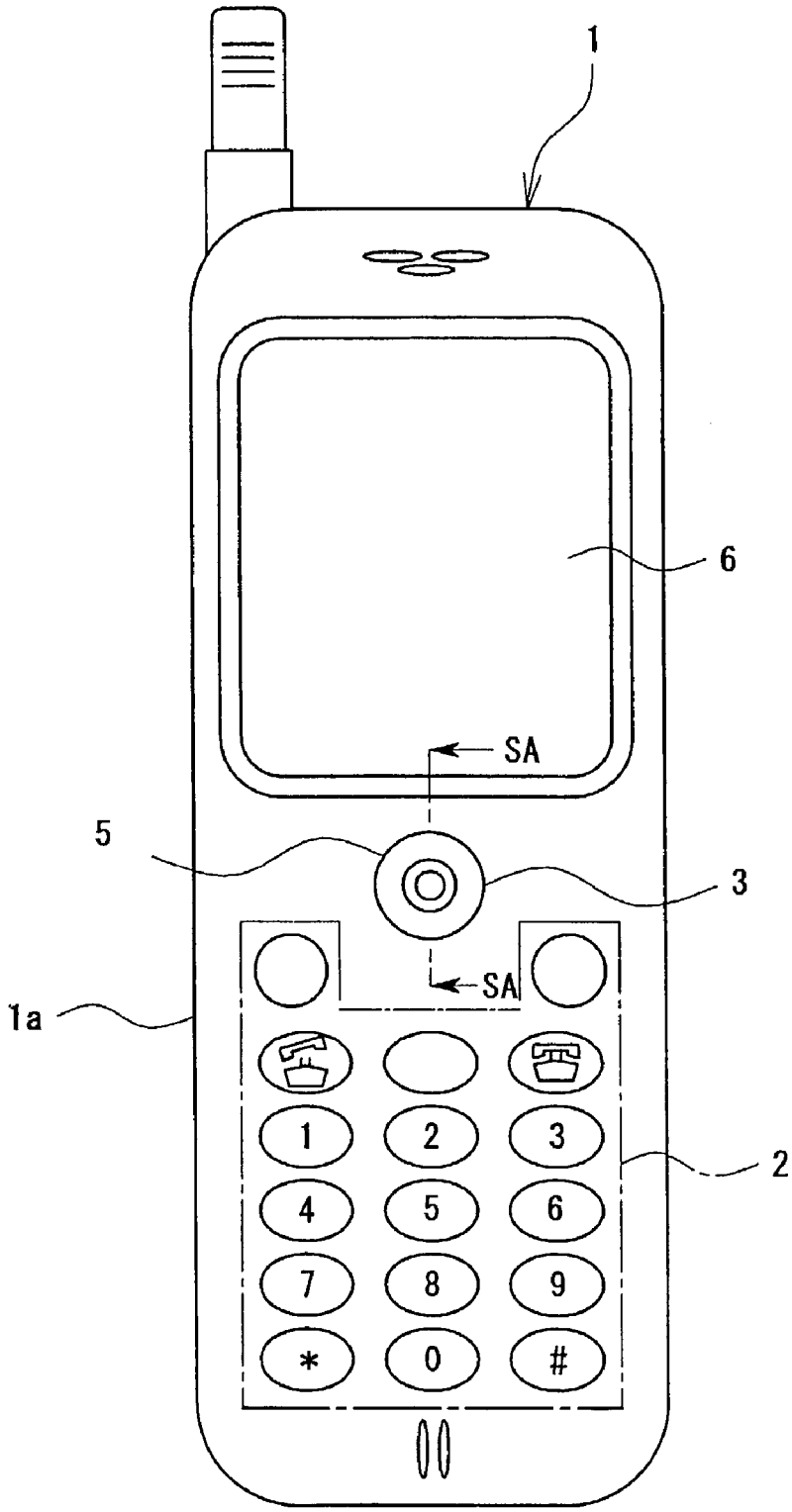
Fig.16(Prior Art)
FIG. 16 is an outward front view of a mobile telephone equipped with a conventional input key.
Figure 17A:
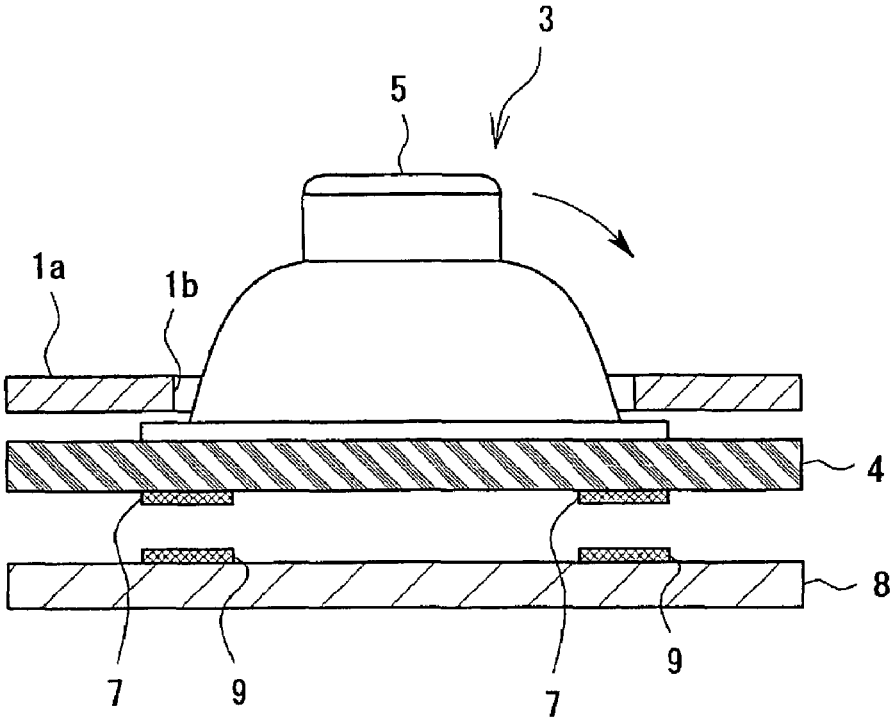
Fig.17A(Prior Art)
Figure 17B:
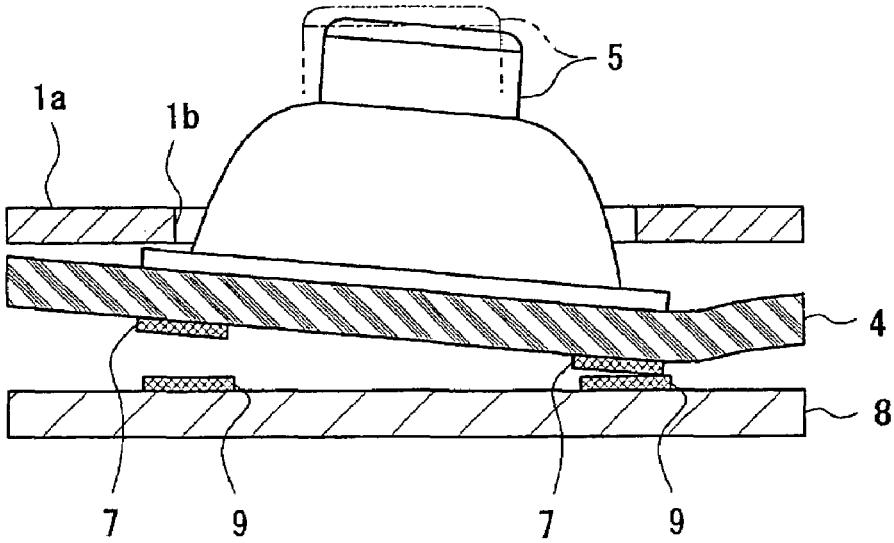
Fig.17B(Prior Art)

FIG. 1 shows a key pad 10 that can be mounted on the above-described mobile telephone 1 shown in FIG. 16. The key pad 10 is equipped with an input key group 13 composed of a key sheet 11 formed of a rubber-like resilient material such as silicone rubber or thermoplastic elastomer, and a plurality of key tops 12 of hard resin joined thereto. Provided above the input key group 13 is a multi-directional input key 14 according to this embodiment. The key pad 10 is secured in position to the casing la of the mobile telephone 1 by means of bosses B1 through B4.

Figure 2:
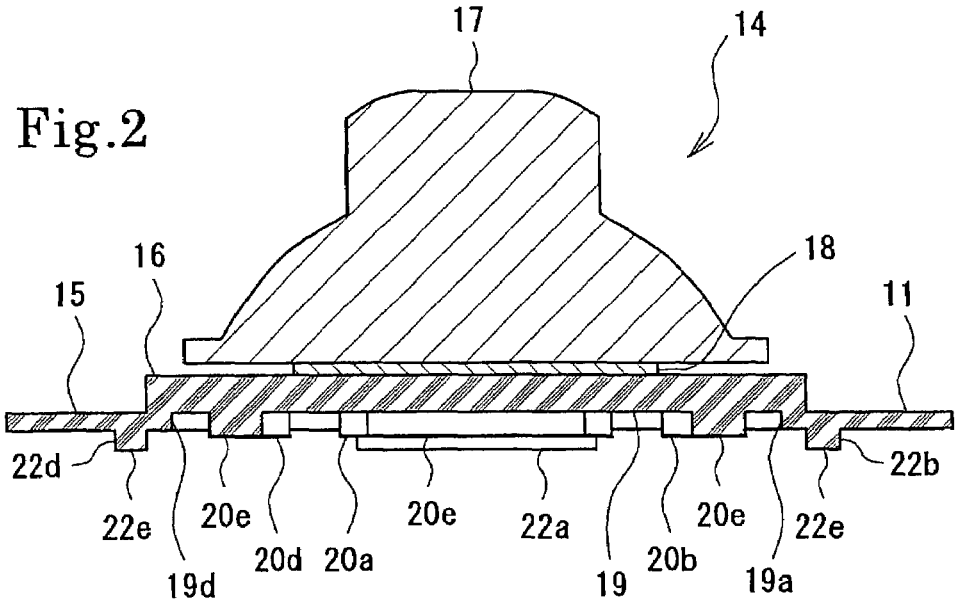
FIG. 2 is a sectional view taken along the line SB—SB of FIG. 1.

As shown in FIG. 2, the multi-directional input key 14 is formed by attaching a stick-shaped key top 17 of hard resin by adhesive 18 to an operation portion 16 one step higher than a common portion 15 of the key sheet 11. The operation portion 16 is capable of vertical movement and oscillation through vertical elastic deflection of the portion of the common portion 15 around the operation portion 16. That is, the operation portion 16 is elastically supported in a floating state, using the portion of the common portion 15 around the operation portion 16 as a "flexible portion". Thus, the key top 17 can be tilted in all directions of 360 degrees, and this tilting makes it possible to perform input operations to bring a board contact of the printed circuit board into conduction.

Figure 3:
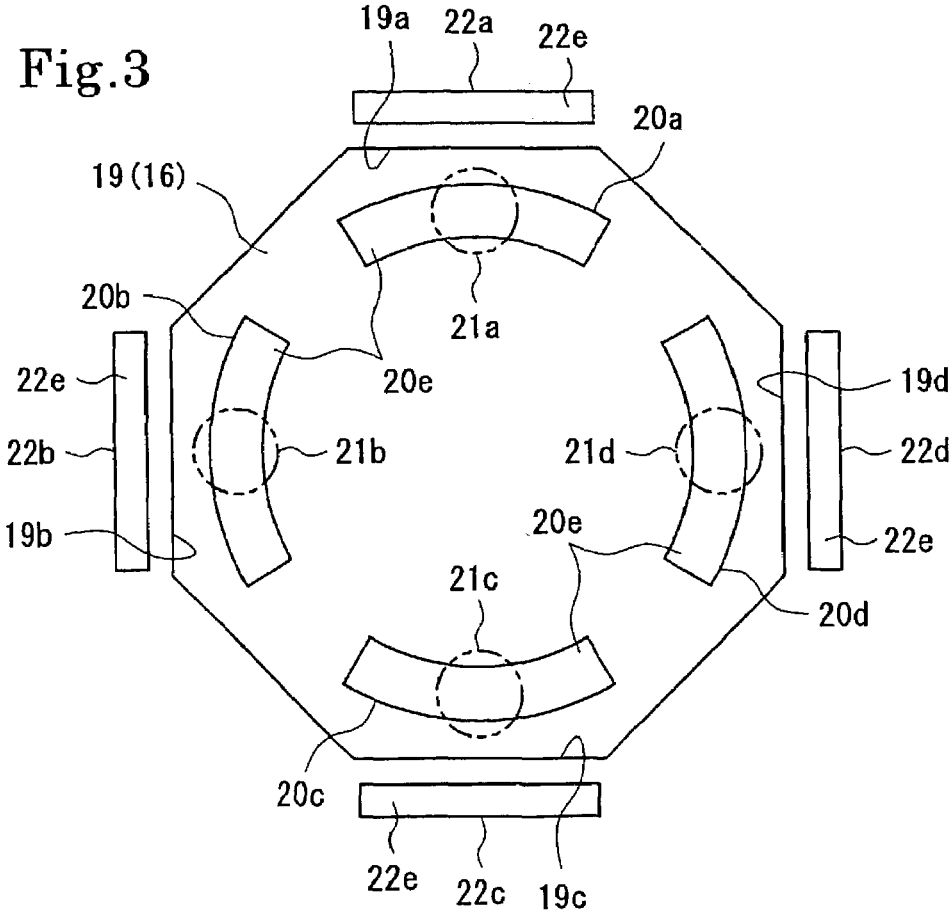
FIG. 3 is a bottom view of the multi-directional input key of FIG. 1.

As shown in FIGS. 2 and 3, the operation portion 16 has an octagonal, recessed bottom portion 19. Formed on the inner sides of the parallel lateral sides 19*a* and 19*c* and the parallel longitudinal sides 19*b* and 19*d* of the bottom portion 19 are downwardly protruding push member portions 20*a*, 20*b*, 20*c*, and 20*d* serving as contact input portions. Each push member portion 20*a*–20*d* is formed as a curved rectangular protrusion extending in the circumferential direction of the bottom portion 19. The circumferential length of the push member portions 20*a*–20*d* is somewhat larger than the length of the lateral side portions 19*a* and 19*c* and the longitudinal side portions 19*b* and 19*d* adjacent thereto. Further, each push member portion 20*a*–20*d* is made longer than each of the board contacts 21*a* through 21*d* provided on the printed circuit board 21. Thus, the push member portions 20*a*–20*d* are brought into contact with the board contacts 21*a* through 21*d* (See FIGS. 14 and 15) with large contact area, making it possible, in particular, to reliably perform input operations with the multi-directional input key 14 of the type which is capable of being tilted in all directions of 360 degrees. To thus bring the board contacts 21*a* through 21*d* into conduction, the forward end surfaces 20*e* of the push member portions 20*a*–20*d* are formed as conductive surfaces with conductive ink applied thereto and cured thereon.

Figure 4:
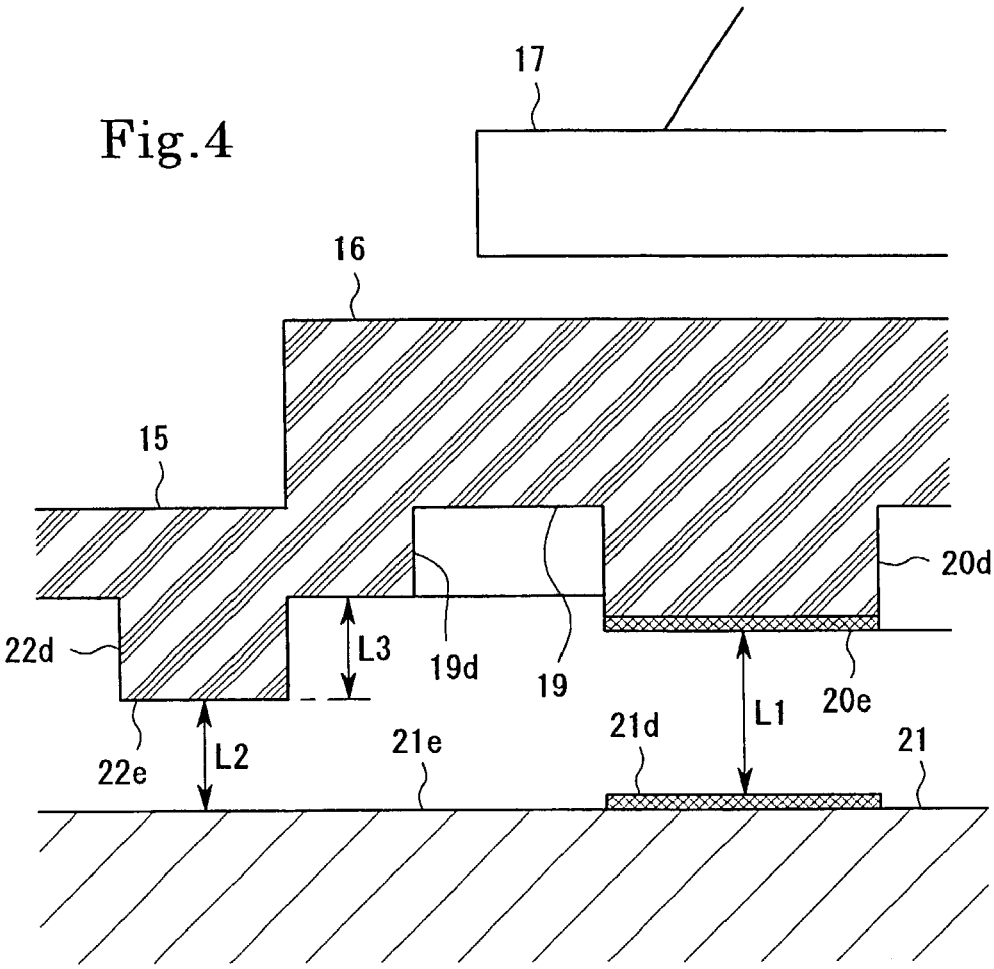
FIG. 4 is a partially enlarged view of portion SC in FIG. 6A.

Formed at positions on the outer side of the push member portions 20*a*–20*d* are rectifying protrusions 22*a* through 22*d*. In this embodiment, the rectifying protrusions 22*a*–22*d* are formed as linear protrusions parallel to the lateral and longitudinal side portions 19*a* through 19*d*. Further, their forward end surfaces 22*e* are formed as flat surfaces parallel to the upper surface portion 21*e* of the printed circuit board 21. The rectifying protrusions 22*a*–22*d* have the same protruding length. More specifically, as shown in FIG. 4, they have a protruding length L3 so that the requisite contact stroke L2 for bringing the rectifying protrusions into contact with the upper surface 21*e* of the printed circuit board 21 is shorter than the requisite input stroke L1 for bringing the push member portions 20*a*–20*d* into contact with the board contacts 21*a* through 21*d* of the printed circuit board 21. That is, the rectifying protrusions 22*a*–22*d* are brought into contact with the upper surface 21*e* of the printed circuit board 21 before the push member portions 20*a*–20*d* bring the board contacts 21*a* through 21*d* into conduction.

Figure 5:
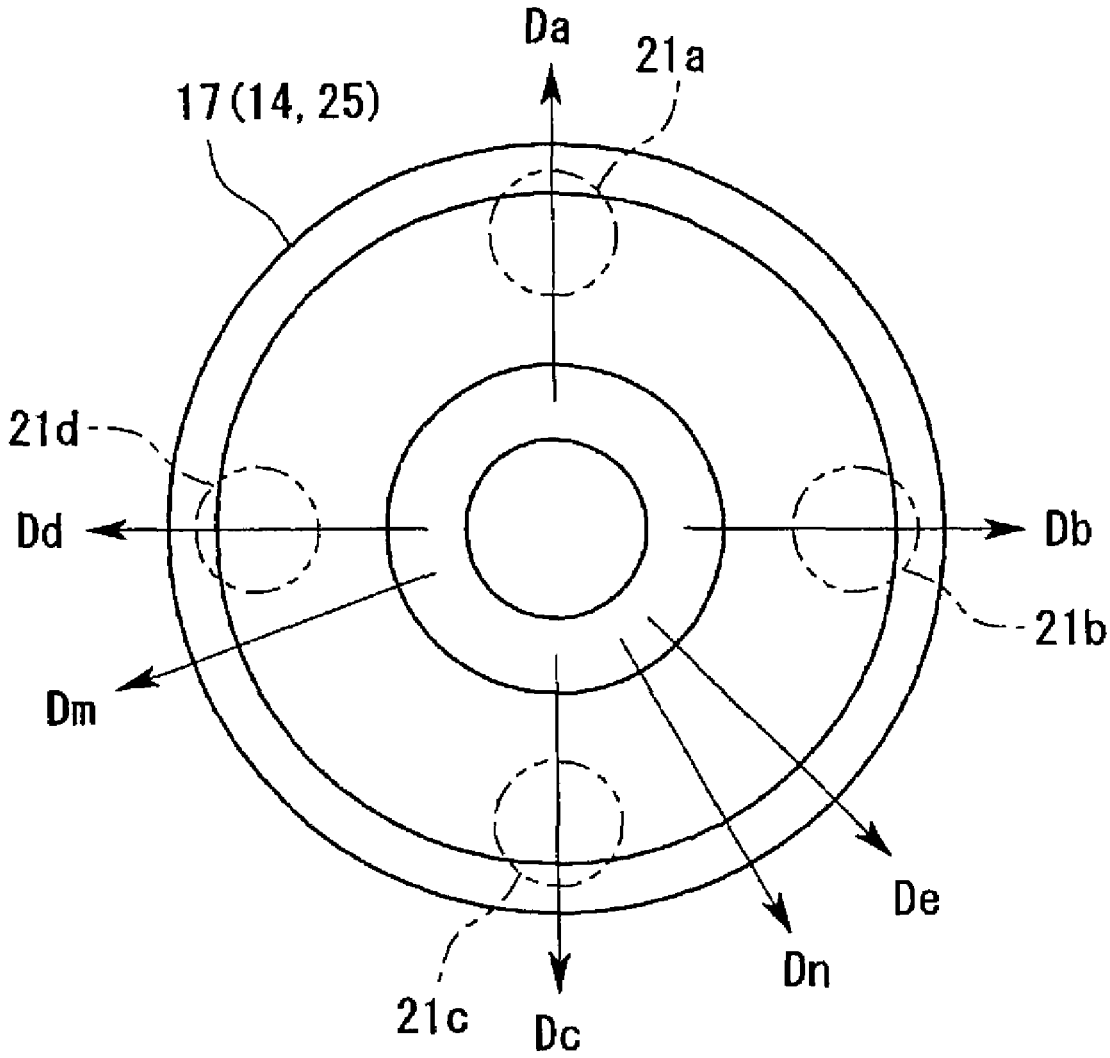
FIG. 5 is an explanatory view illustrating tilting directions of the multi-directional input key of FIG. 1.

Next, the operation of the key input device of this embodiment equipped with the multi-directional input key 14, constructed as described above, will be illustrated with reference to FIGS. 5 through 7. Here, as shown in FIG. 5, a case will be illustrated in which the multi-directional input key 14 is tilted in a normal tilting direction Dd to bring the board contact 21*d* of the printed circuit board 21 into conduction. The operations in tilting the multi-directional input key 14 in other normal directions Da through Dc in order to bring the board contacts 21*a* through 21*c* into conduction are the same, so that a description thereof will be omitted.

Figure 6A:
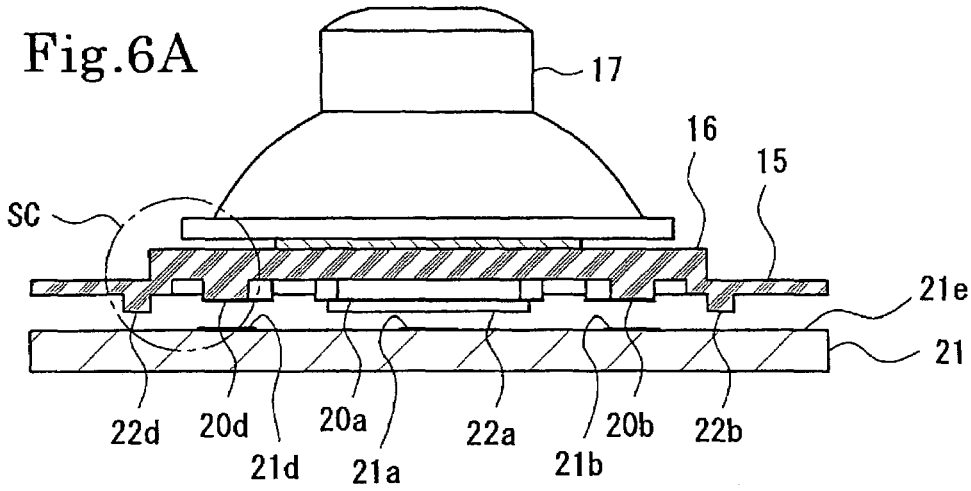
Figure 7A:
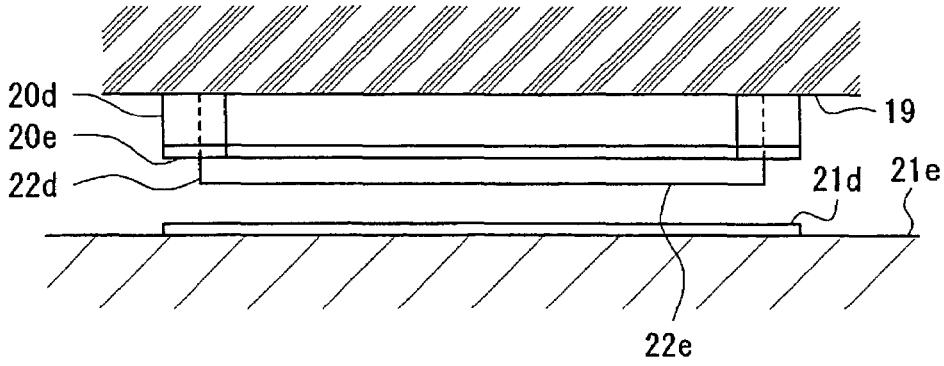

As shown in FIGS. 6A and 7A, the common portion 15 and the operation portion 16 of the multi-directional input key 14 are floatingly supported with respect to the printed circuit board 21. This floating support is realized, for example, by a support portion consisting of a protrusion or the like formed on the key sheet 11, or by a mounting structure or the like in which the key sheet 11 is fixed to the back side of the casing la of the mobile telephone 1 to thereby realize floating support with respect to the printed circuit board 21. And, when in this state the key top 17 is tilted in the normal tilting direction Dd (See FIG. 5), the push member portion 20*d* is lowered to accurately come into contact with the board contact 21*d* of the printed circuit board 21 to bring it into conduction, thus effecting input correctly.

Figure 6B:
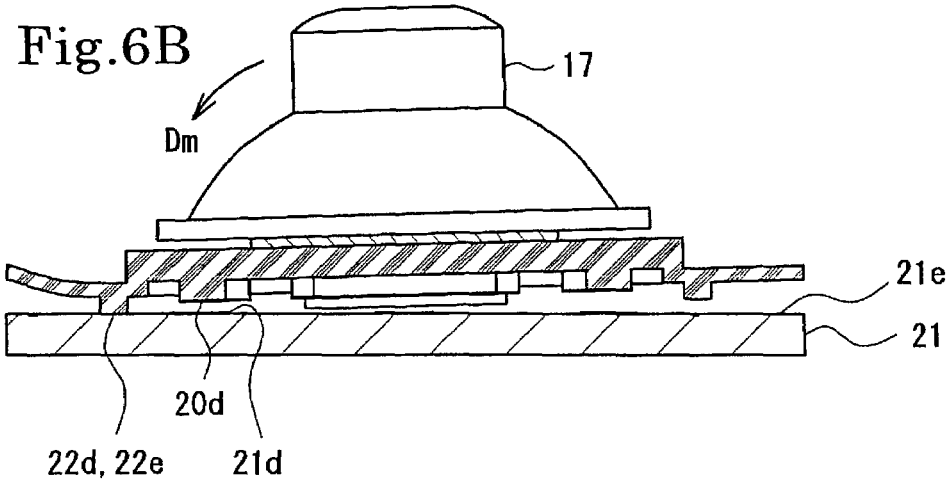
Figure 6C:
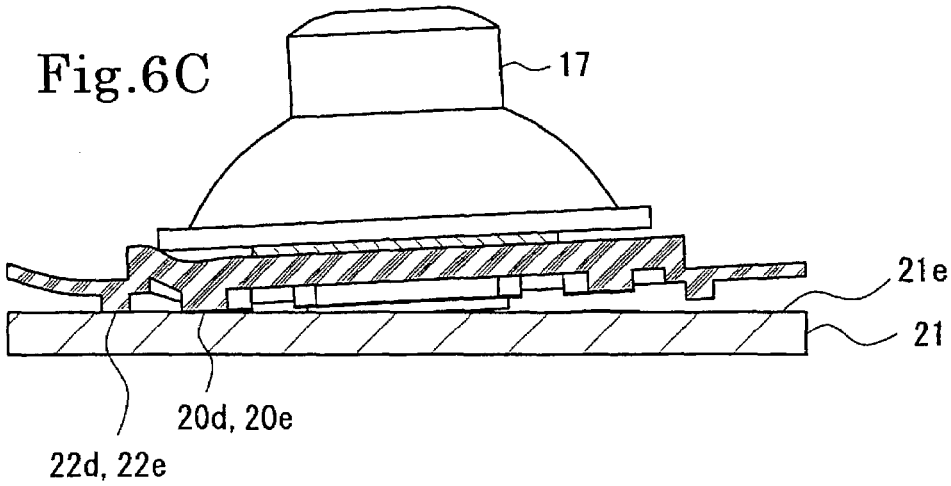
Figure 7B:
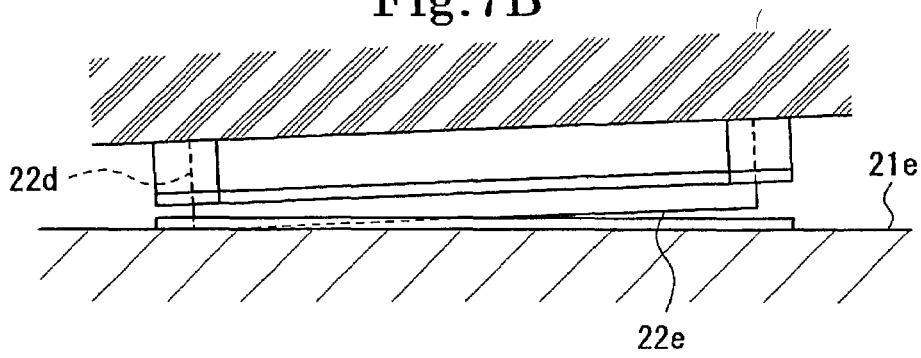
Figure 7C:
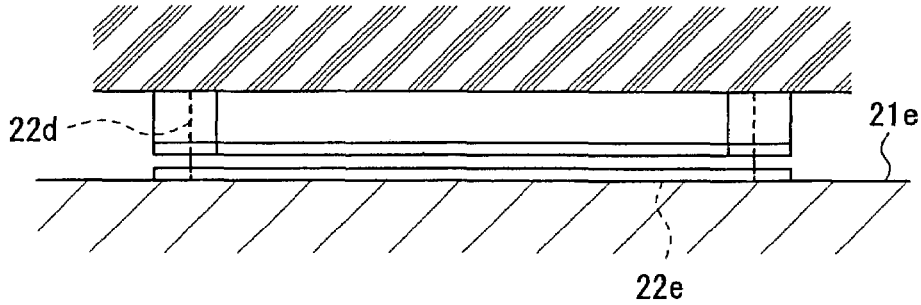

If, however, as shown in FIG. 5, the multi-directional input switch is tilted in a direction Dm which is oblique with respect to the normal tilting direction Dd, the operation portion 16 is tilted in the oblique direction Dm, as shown in FIGS. 6B and 7B, and only one side end portion of the forward end surface 22*e* of the rectifying protrusion 22*d* having the protruding length L3 first comes into contact with the upper surface portion 21*e* of the printed circuit board 21. If the key top continues to be tilted in the oblique direction Dm, the key top 17 and the operation portion 16 are rotated toward the normal tilting direction Dd, using the one side end portion of the forward end surface 22*e* in contact with the printed circuit board as a fulcrum, and at the same time, the contact area of the forward end surface 22*e* with respect to the upper surface portion 21*e* gradually increases to be eventually brought into full contact as shown in FIG. 7C.

Figure 7D:
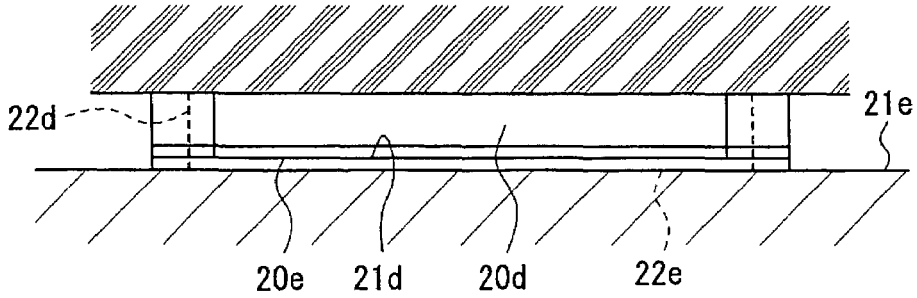

And, if the tilting of the key top 17 in the oblique direction Dm is further continued, the tilting direction thereof is rectified to the normal tilting direction Dd by the rectifying protrusion 22*d* whose forward end surface 22*e* is in full contact, so that, as shown in FIG. 7D, the forward end surface 20*e* of the push member portion 20*d* is correctly brought into contact with the board contact 21*d* of the printed circuit board 21. Thus, if the operator inadvertently tilts the key top 17 in the oblique direction Dm, the tilting attitude of the operation portion 16 is eventually rectified to the normal tilting direction Dd by the rectifying protrusion 22*d*, and it is possible to bring the board contact 21*d* into conduction correctly, thus making it possible to suppress erroneous input.

The tilting direction rectifying function provided by the rectifying protrusions 22*a* through 22*d* is made more effective by the fact that the rectifying protrusions 22*a* through 22*d* are formed as longitudinally continuous blocks and that the forward end surfaces 22*e* thereof are formed as flat surfaces. Further, this construction is suitable for the multi-directional input key 14, which is operated frequently. Due to the fact that the rectifying protrusions 22*a* through 22*d* are formed as longitudinally continuous blocks, it is possible to secure the requisite rigidity for the rectifying protrusions 22*a* through 22*d*, making it possible to exert the above-described rectifying function more reliably. Further, the repeatedly generated contact stress between them and the printed circuit board 21 is dispersed to thereby achieve an improvement in durability. Further, since the forward end surfaces 22*e* of the rectifying protrusions 22*a* through 22*d* are formed as flat surfaces, it is possible to secure a large contact area between them and the upper surface portion 21*e* of the printed circuit board 21 in a stable manner, making it possible to reliably exert the function of rectifying the tilting direction of the key top 17. Thus, it is desirable for the rectifying protrusions 22*a* through 22*d* to be of the configuration as shown. However, if it is only necessary to correctly bring the board contacts 21*a* through 21*d* into conduction, the rectifying protrusions 22*a* through 22*d* may be longitudinally divided into a plurality or parts. Further, instead of being made linear, they may be formed in a V-shaped configuration or the like in plan view. Further, instead of forming their forward end surfaces 22*e* as flat surfaces, it is possible to form them in a downwardly dome-shaped configuration in the width direction of the rectifying protrusions 22*a* through 22*d* or in a pointed configuration.

Further, while in the above example the key top 17 is formed in a stick-like configuration, it is also possible to form it as a block-like key top with height or a flat disc-like key top. Further, instead of providing the key top, it is also possible to use the upper surface of the operation portion 16 of the key sheet 11 as the multi-directional input key exposed through the casing la of the mobile telephone 1.

Second Embodiment (FIGS. 8 through 13)

Figure 8:
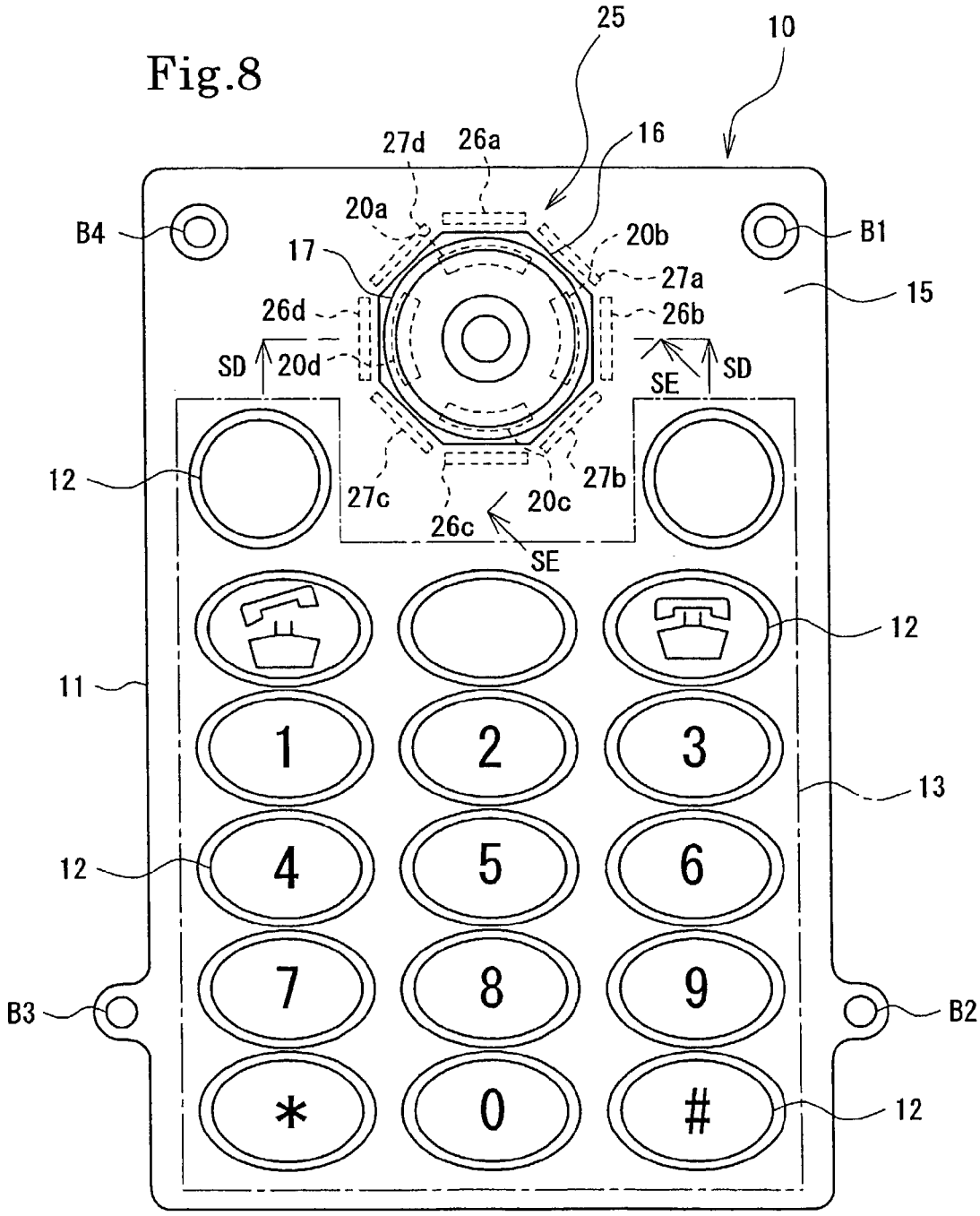
FIG. 8 is a plan view of a key pad equipped with a multi-directional input key according to a second embodiment of the present invention.
Figure 9:
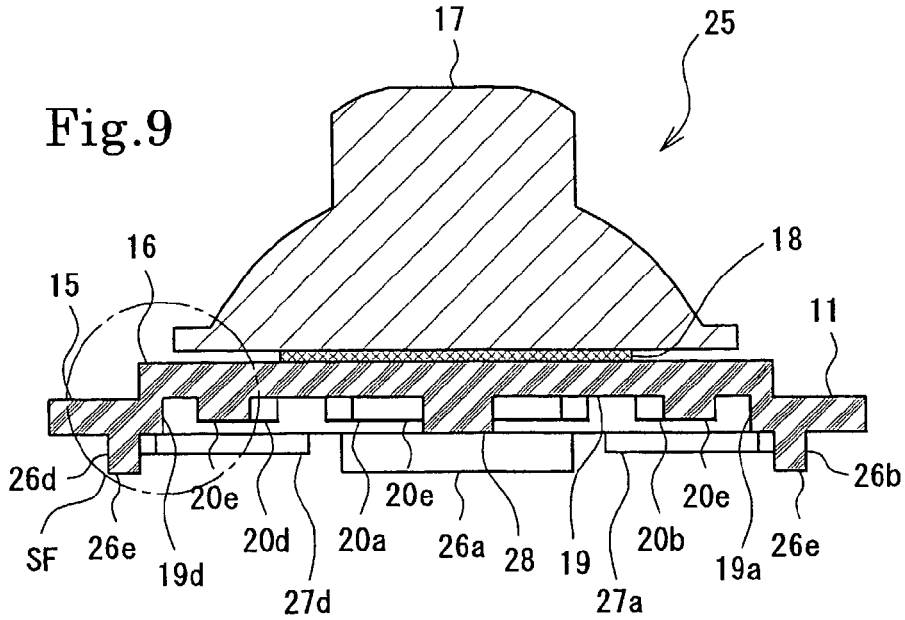
FIG. 9 is a sectional view taken along the line SD—SD of FIG. 8.
Figure 10:
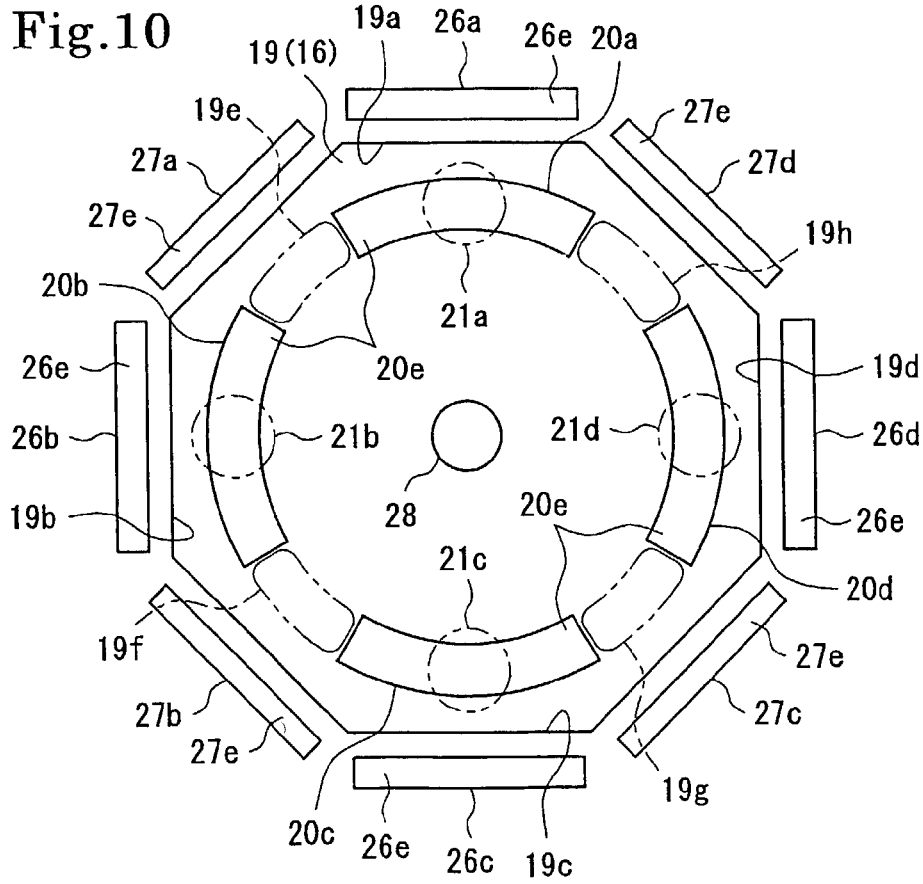
FIG. 10 is a bottom view of the multi-directional input key of FIG. 8.

The key pad 10 shown in FIG. 8 can also be mounted on the mobile telephone 1 of FIG. 16. Numeral 25 indicates the multi-directional input key of the second embodiment. The multi-directional input key 25 differs from that of the first embodiment in the following points. First, the rectifying protrusions 22*a* through 22*d*, described with reference to the first embodiment, are utilized as support protrusions 26*a* through 26*d* for floatingly supporting the multi-directional input key 25 with respect to the upper surface portion 21*e* of the printed circuit board 21 when the input key is not being operated. Second, at positions on the outer side of four interval portions 19*e*, 19*f*, 19*g*, and 19*h* of the bottom 19 of the operation portion 16, there are provided rectifying protrusions 27*a* through 27*d* functioning in the same way as the rectifying protrusions 22*a* through 22*d* of the first embodiment. Third, a push member portion 28 is provided at the center of the bottom 19 of the operation portion 16. Fourth, not only is a predetermined input effected upon conduction of each of the board contacts 21*a* through 21*d* (See FIGS. 14 and 15), but input is also effected upon conduction between adjacent ones of the board contacts 21*a* through 21*d*.

In order to floatingly support the rectifying protrusions 27 with respect to the upper surface 21*e* of the printed circuit board 21, the support protrusions 26*a* through 26*d*, constituting the first feature of this embodiment, protrude from the back surface of the common portion 15 by a large length L4, and the forward end surfaces 26*e* thereof are formed as flat surfaces for stable support of the multi-directional input key 25.

Figure 11:
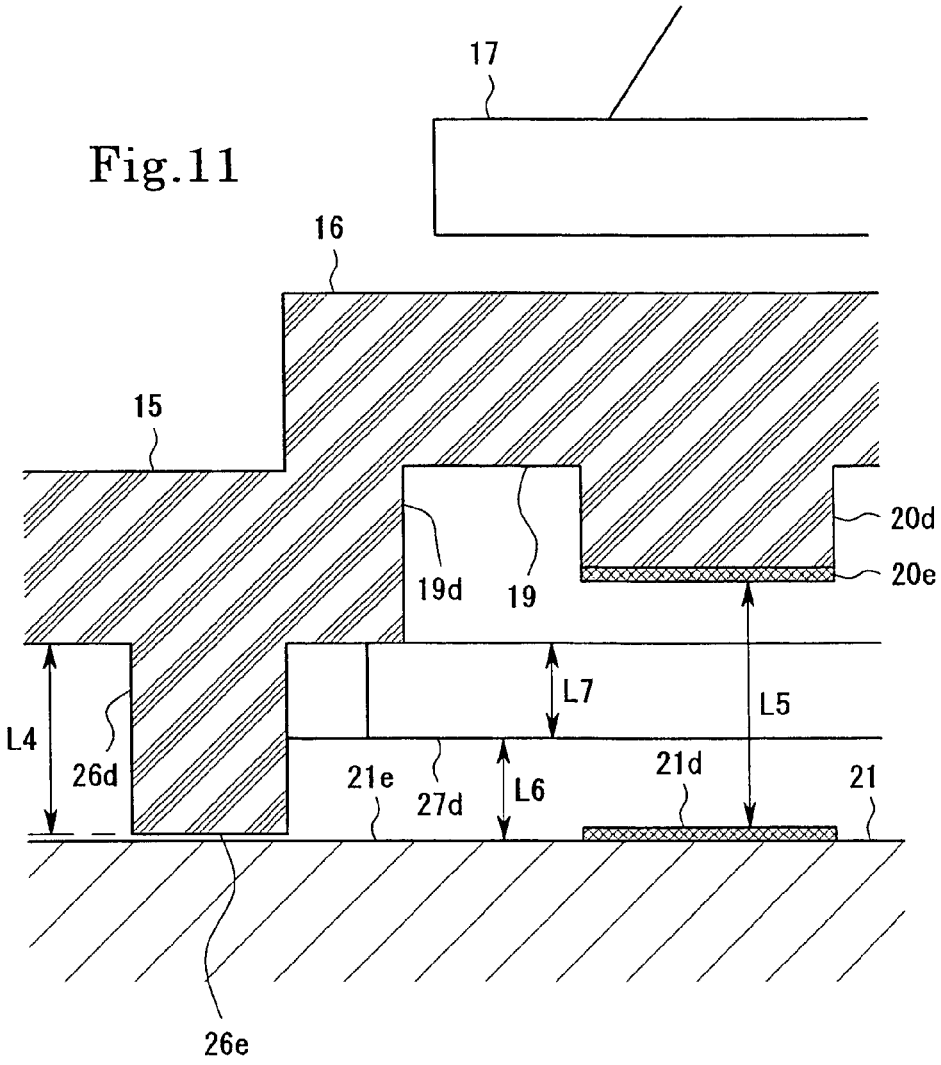
FIG. 11 is a partial enlarged view corresponding to portion SF of FIG. 9.
Figure 12:
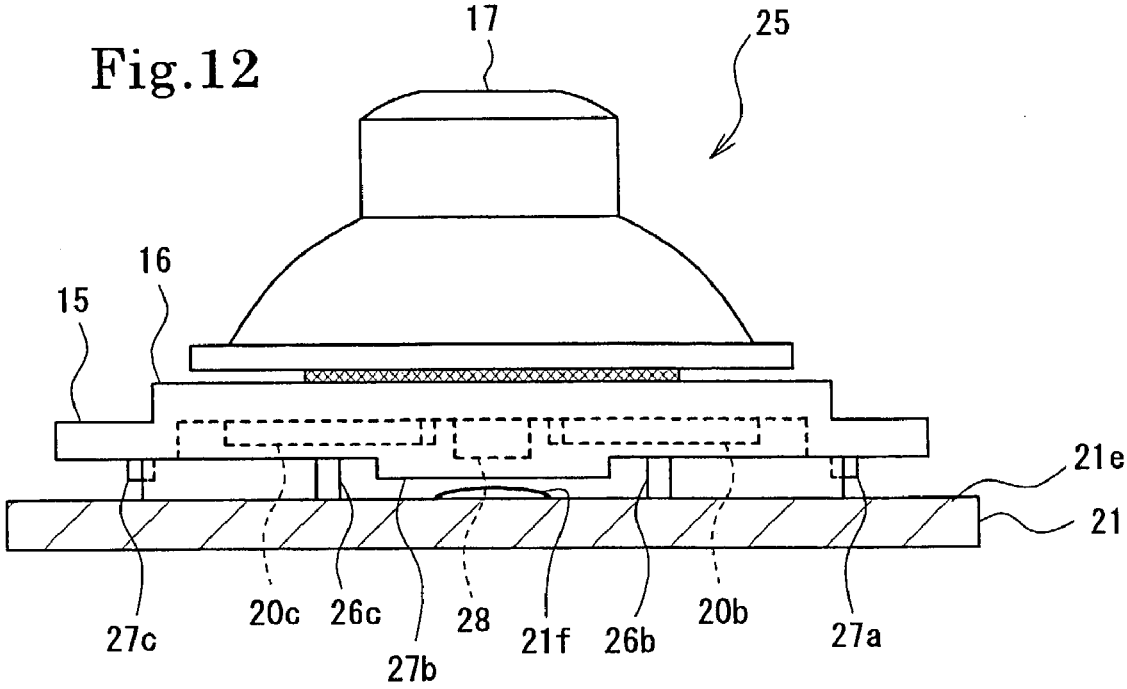
FIG. 12 is a sectional view taken along the line SE—SE of FIG. 8.

The rectifying protrusions 27*a* through 27*d*, constituting the second feature of this embodiment, are provided at positions outside the radial interval portions 19*a* through 19*h* of the bottom 19 of the operation portion 16. The interval portions 19*e* through 19*h* are portions spacing the adjacent board contacts 21*a* through 21*d* of the printed circuit board 21 from each other. The adjacent board contacts 21*a* through 21*d* are electrically insulated from each other by the interval portions 19*e* through 19*h*. The rectifying protrusions 27*a*–27*d* have the same protrusion length. Specifically, as shown in FIG. 11, they protrude by a protrusion length L7 such that the contact stroke L6 for contact with the upper surface 21*e* of the printed circuit board 21 is shorter than the input stroke L5 for bringing the push member portions 20*a*–20*d* into contact with the board contacts 21*a* through 21*d* of the printed circuit board 21 to bring them into conduction. That is, the rectifying protrusions 27*a*–27*d* are brought into contact with the upper surface 21*e* of the printed circuit board 21 before the push member portions 20*a*–20*d* bring, the board contacts 21*a* through 21*d* into conduction.

The push member portion 28, constituting the third feature of this embodiment, is provided at the center of the bottom 19. When the key top 17 is depressed, input is effected through a belleville spring contact portion 21*f* (See FIG. 12) of the printed circuit board 21 provided directly below it. This makes it possible to cope with an expansion of variety of the functions of the mobile telephone 1.

According to the fourth feature of this embodiment, the multi-directional input key 25 is constructed such that input is also effected when the adjacent board contacts 21*a* through 21*d* are brought into conduction. In this embodiment, when effecting this input (hereinafter referred to as oblique input) the rectifying protrusions 27*a*–27*d* serve to reliably effect input between two adjacent ones of the board contacts 21*a* through 21*d*.

That is, when, as shown in FIG. 5, oblique input is to be effected so as to simultaneously bring the board contact 21*c* and the board contact 21*d* into conduction, the key top 17 is tilted in the normal tilting direction De. Then, the push member portions 20*b* and 20*c* are lowered to be correctly brought into contact with the board contacts 21*b* and 21*c* to simultaneously bring them into conduction, thus making it possible to correctly effect oblique input.

Figure 13A:
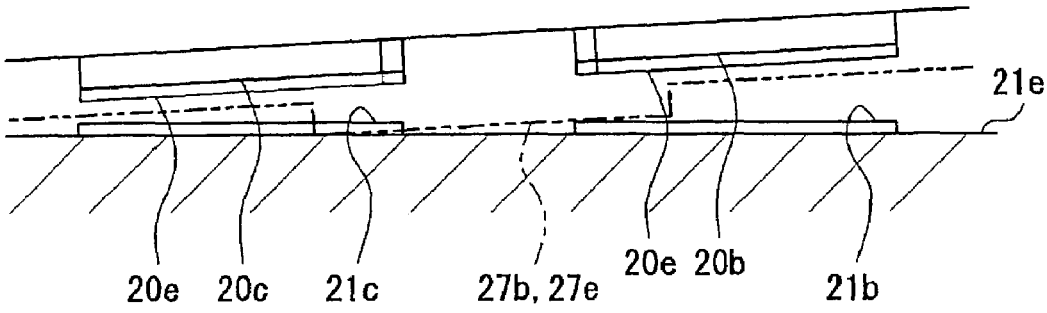
Figure 13B:
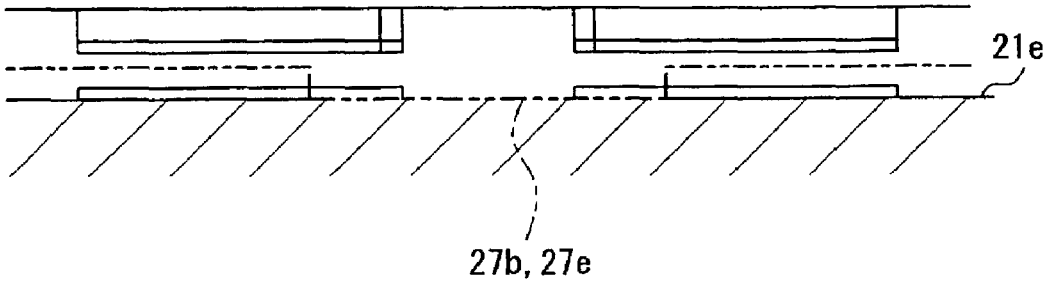

However, when, as shown in FIG. 5, the key top is tilted in the direction Dn oblique with respect to the normal tilting direction Dd, the operation portion 16 is tilted in the oblique direction Dn as shown in FIG. 13A, and only one end portion of the forward end surface 27*e* of the rectifying protrusion 27*b* is first brought into contact with the upper surface 21*e* of the printed circuit board 21. If the tilting is continued in the oblique direction Dn, the key top 17 and the operation portion 16 are rotated toward the normal tilting direction De, using the one end portion of the rectifying protrusion 27*b* in contact with the circuit board as a fulcrum, and, at the same time, the contact area of the forward end surface 27*e* with respect to the upper surface 21*e* increases gradually, the forward end surface 27*e* being eventually brought into full contact as shown in FIG. 13B.

Figure 13C:
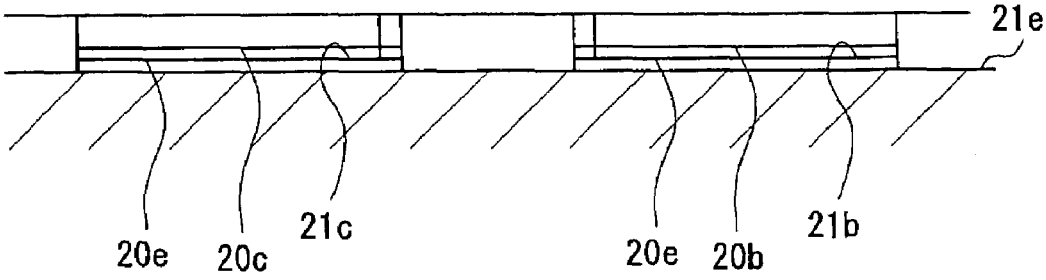

And, even if this tilting in the oblique direction Dn is further continued, the tilting direction is rectified to the normal tilting direction De by the rectifying protrusion 27*b*, which is in full contact. Thus, as shown in FIG. 13C, the forward end surfaces 20*e* of the push member portions 20*b* and 20*c* are brought into contact with the board contacts 21*b* and 21*c* of the printed circuit board 21 reliably and correctly. In this way, even if the operator inadvertently tilts the key top 17 in the oblique direction Dn, the key top is eventually caused to be tilted in the normal tilting direction De by the rectifying protrusion 27*b*, and it is possible to correctly effect oblique input to simultaneously bring the board contacts 21*b* and 21*c* into conduction, thus suppressing erroneous input.

The above-described tilting direction rectifying function of the rectifying protrusions 27*a* through 27*d* is further enhanced by the formation of the support protrusions 26*a* through 26*d* at outside positions at the ends of the rectifying protrusions 27*a* through 27*d*. That is, since the support protrusions 26*a* through 26*d* are in contact with the upper surface 21*e* of the printed circuit board 21 beforehand, even if the key top is tilted in an oblique direction (Dn) as described above, an excessive inclination of the key top 17 is mitigated to some extent by the support protrusions 26*a* through 26*d* before the rectifying function of the rectifying protrusions 27*a*–27*d* is exerted. And, due to the further exertion of the rectifying function of the rectifying protrusions 27*a*–27*d*, it is possible to effect oblique input reliably as described above. Thus, when this synergistic effect of the support protrusions 26*a*–26*d* is not desired, it is possible to abolish the support protrusions 26*a*–26*d*. The rectifying protrusions 27*a*–27*d* of this embodiment are similar to the rectifying protrusions 22*a*–22*d* of the first embodiment in that they are formed as longitudinally extending elongated blocks to thereby achieve rigidity and an improvement in durability, that their forward end surfaces 27*e* are formed as flat surfaces to thereby secure the requisite contact area in a stable manner, and that the function of rectifying the tilting direction of the key top 17 can be reliably exerted. Further, like the first embodiment, this embodiment allows various modifications.

Figure 14:
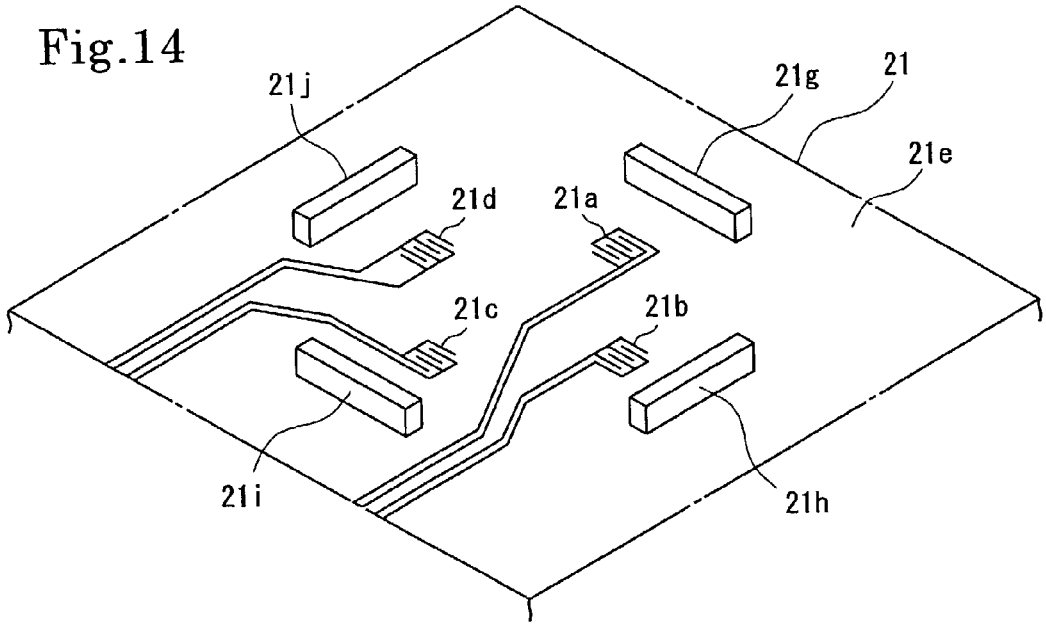
FIG. 14 is a partial plan view of a printed circuit board to which a key input device according to another embodiment is applied.
Figure 15:
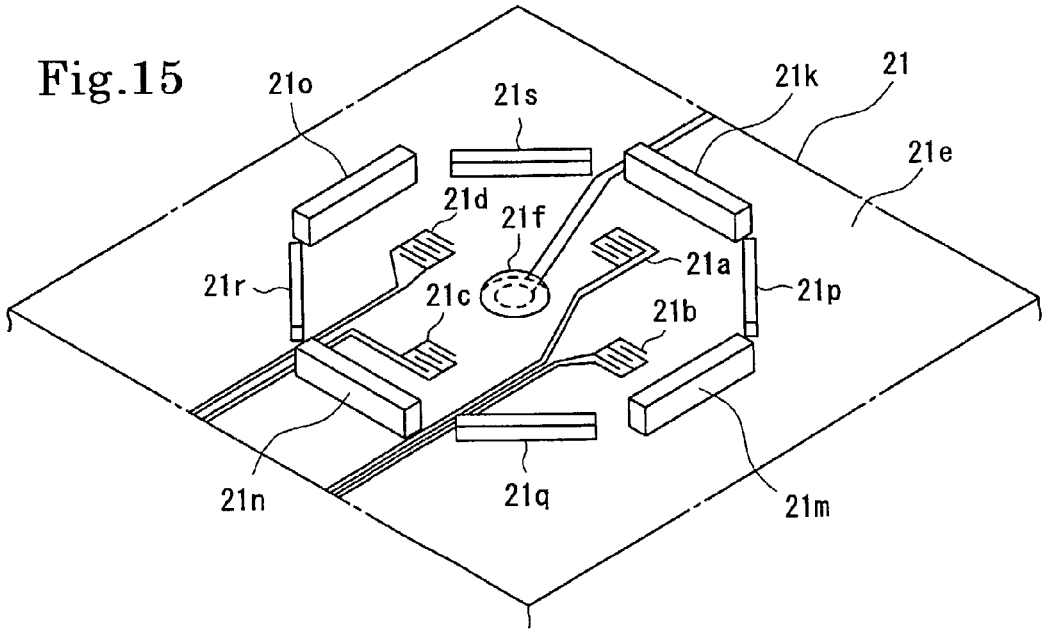
FIG. 15 is a partial plan view of a printed circuit board to which a key input device according to still another embodiment is applied.

Other Embodiments (FIGS. 14 and 15)

In the multi-directional input key and the key input device of the present invention, it is also possible to floatingly support the support protrusions 26*a*–26*d*, instead of bringing the support protrusions 26*a*–26*d* into contact with the upper surface 21*e* of the printed circuit board 21 as in the case of the multi-directional input key 25 of the second embodiment. In this case, the support protrusions 26*a*–26*d* function as rectifying protrusions similar to the rectifying protrusions 22*a*–22*d* of the first embodiment. Thus, for the individual input through the board contacts 21*a* through 21*d*, the support protrusions 26*a* through 26*d* (the rectifying protrusions 22*a* through 22*d*) function so as to rectify the tilting direction of the key top 17 as described with reference to the first embodiment, and, for oblique input, the rectifying protrusions 27*a* through 27*d* function so as to rectify the tilting direction as described with reference to the second embodiment. In this case, it does not matter whether it is the support protrusions 26*a*–26*d* or the rectifying protrusions 27*a*–27*d* that come into contact with the upper surface 21*e* first. In either case, they must be brought into contact with the upper surface before the board contacts 21*a* through 21*d* are brought into conduction.

Further, while in the above-described embodiments the operation portion 16 is one step higher than the common portion 15, it is also possible to form these portions so as to be flush with each other.

Further, while in the above-described embodiments the present invention is applied to the key pad 10 in which the key top 17 of hard resin is joined to the key sheet 11, the key top 17 may be of any type of configuration inclusive of a flat one. Further, the present invention is also applicable to a film-integrated-type key top obtained by forming, on a resin film, protrusions of a configuration corresponding to a multi-directional input key by a drawing process using a molding die, placing this resin film in an injection molding die, and pouring liquid resin consisting of molten thermoplastic resin or the like into the inner space of each protrusion to allow it to cure to thereby form a key top main body integrated with the resin film. Further, it is also possible to abolish the key top 17, forming a multi-directional input key consisting solely of the key sheet 11.

Further, while in the above-described embodiments there are provided four push member portions 20*a* through 20*d* corresponding to the four board contacts 21*a* through 21*d*, the number of these components is not restricted to four. And, the above embodiments are applicable not only to the input key of the mobile telephone 1, but also to the input key of some other electric apparatus.

While in the first embodiment the rectifying protrusions 22*a* through 22*d* are formed integrally with the key sheet 11, it is also possible, as shown in FIG. 14, to join rectifying protrusions 21*g*, 21*h*, 21*i*, and 21*j* formed of a rubber-like resilient material such as silicone rubber or thermoplastic elastomer, or synthetic resin to the upper surface 21*e* of the printed circuit board 21 opposed to the key sheet 11 by using fixing means such as adhesive or double-faced tape, making them function in the same way as the rectifying protrusions 22*a* through 22*d*.

Further, while in the above-described second embodiment the support protrusions 26*a* through 26*d* and the rectifying protrusions 27*a* through 27*d* are formed integrally with the key sheet 11, it is also possible, as shown in FIG. 15, to join support protrusions 21*k*, 21*m*, 21*n*, and 21*o* and rectifying protrusions 21*p*, 21*q*, 21*r*, and 21*s* formed of a rubber-like resilient material such as silicone rubber or thermoplastic elastomer, or synthetic resin to the upper surface 21*e* of the printed circuit board 21 opposed to the key sheet 11 by using fixing means such as adhesive or double-faced tape, causing them to function in the same way as the support protrusions 26*a* through 26*d* and the rectifying protrusions 27*a* through 27*d*.

In the multi-directional input key and the key input device of the present invention, even if the input key is tilted in an erroneous direction, it can be rectified to the normal tilting direction by a rectifying protrusion, so that it is possible to minimize erroneous input through the input key and realize a satisfactory operability. Thus, it is possible to suppress as much as possible the occurrence of problems such as re-input and malfunction of the apparatus, which means the present invention proves of high practical value as a superior user interface.

What is claimed is:

1. A multi-directional input key comprising:

an operation portion floatingly supported with respect to a circuit board; and contact input portions which are provided to the operation portion and opposed to a plurality of board contacts annularly arranged on the circuit board, in which tilting of the operation portion brings the board contacts opposed to the contact input portions into conduction to effect a predetermined input operation, wherein the operation portion is equipped with a rectifying protrusion adapted to come into contact with the circuit board before the board contacts are brought into conduction by tilting the operation portion to thereby rectify a tilting attitude of the operation portion toward a normal tilting direction.

2. A multi-directional input key according to claim 1, wherein the rectifying protrusion is provided at an outer position with respect to each of the contact input portions.

3. A multi-directional input key according to claim 1, wherein a predetermined input operation is effected by simultaneously causing adjacent contact input portions to bring the opposed board contacts into conduction by tilting the operation portion, and wherein the rectifying protrusion is provided at an outer position with respect to an interval portion by which adjacent contact input portions are spaced apart from each other.

4. A multi-directional input key according to any one of claims 1 to 3, further comprising a support protrusion for floatingly supporting the rectifying protrusion with respect to the circuit board.

5. A multi-directional input key according to claim 4, wherein the support protrusion is floatingly supported with respect to the circuit board and adapted to be brought into contact with the circuit board earlier than the rectifying protrusion by tilting the operation portion.

6. A multi-directional input key according to claim 4, wherein each of the contact input portions is formed as a downwardly protruding push member portion having a curved rectangular configuration extending along the annular arrangement direction and having a forward end surface parallel to the circuit board.

7. A multi-directional input key according to any one of claims 1 to 3, wherein each of the contact input portions is formed as a downwardly protruding push member portion having a curved rectangular configuration extending along the annular arrangement direction and having a forward end surface parallel to the circuit board.

8. A key input device comprising:

an input key for performing input operation; and a circuit board having a plurality of board contacts annularly arranged and opposed to a bottom portion of the input key, in which tilting of the input key brings the board contacts into conduction for a predetermined input operation, wherein one of the bottom portion of the input key and the circuit board is equipped with a rectifying protrusion adapted to come into contact with the other one of the bottom portion of the input key and the circuit board before the board contacts are brought into conduction by tilting the input key to thereby rectify a tilting attitude of the input key toward a normal tilting direction.

9. A key input device according to claim 8, wherein the rectifying protrusion is provided at any one of an outer position with respect to each of the board contacts of the circuit board and an opposing position at the bottom portion of the input key opposed to the outer position.

10. A key input device according to claim 8, wherein a predetermined input operation is effected by simultaneously bringing adjacent board contacts into conduction by tilting the input key, and wherein the rectifying protrusion is provided at any one of an outer position with respect to an interval portion by which adjacent board contacts of the circuit board are spaced apart from each other and an opposing position at the bottom portion of the input key opposed to the outer position.

11. A key input device according to any one of claims 8 to 10, wherein one of the input key and the circuit board is provided with a support protrusion for supporting the rectifying protrusion floatingly with respect to the circuit board.

12. A key input device according to claim 11, wherein the support protrusion is floatingly supported with respect to one of the input key and the circuit board and adapted to be brought into contact with the other one of the input key and the circuit board earlier than the rectifying protrusion by tilting the input key.

* * * * *